US008620176B2

(12) United States Patent
Xu et al.

(10) Patent No.: US 8,620,176 B2
(45) Date of Patent: Dec. 31, 2013

(54) CASING PROJECTIONS OF AN IMAGE FORMING APPARATUS CONFIGURED TO SUPPORT A SEAL OF A DEVELOPING DEVICE

(75) Inventors: Fan Xu, Nagoya (JP); Takashi Yasuda, Nagoya (JP); Mitsuru Horinoe, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 239 days.

(21) Appl. No.: 13/053,330

(22) Filed: Mar. 22, 2011

(65) Prior Publication Data

US 2011/0255901 A1 Oct. 20, 2011

(30) Foreign Application Priority Data

Apr. 15, 2010 (JP) ..... 2010-093602

(51) Int. Cl.
*G03G 15/08* (2006.01)

(52) U.S. Cl.
USPC ..... 399/103

(58) Field of Classification Search
USPC ..... 399/103
See application file for complete search history.

(56) References Cited

U.S. PATENT DOCUMENTS

| | | | |
|---|---|---|---|
| 6,937,831 | B2 | 8/2005 | Kamimura |
| 2003/0118364 | A1 | 6/2003 | Kamimura |
| 2004/0001727 | A1 | 1/2004 | Akutsu |
| 2009/0010676 | A1 | 1/2009 | Kobayashi |
| 2009/0226207 | A1 | 9/2009 | Matsushita |
| 2009/0274481 | A1 | 11/2009 | Xu et al. |

FOREIGN PATENT DOCUMENTS

| | | | |
|---|---|---|---|
| JP | 6-41258 | | 10/1994 |
| JP | 09-022185 | | 1/1997 |
| JP | 2001154480 | A | 6/2001 |
| JP | 2003195630 | A | 7/2003 |
| JP | 2003-337473 | | 11/2003 |
| JP | 2004125930 | A | 4/2004 |
| JP | 2009-003308 | | 1/2009 |
| JP | 2009-063635 | | 3/2009 |
| JP | 2009244451 | A | 10/2009 |

OTHER PUBLICATIONS

Computer translation of JP2004-125930A.*
Notification of Reasons for Refusal for Japanese patent application No. 2010-093602 mailed Feb. 22, 2012.
Notification of First Office Action issued in corresponding Chinese Patent Application No. 201110075917.4 dated Oct. 26, 2012.

* cited by examiner

*Primary Examiner* — Quana M Grainer
(74) *Attorney, Agent, or Firm* — Banner & Witcoff, Ltd.

(57) ABSTRACT

A developing device comprising: a developing roller; a casing that includes a developer storage unit; a roller supporting unit and an opening; and a seal member that is mounted on the casing outside the opening in the central axis direction and faces an end portion of the developing roller, the seal member configured to rub against the end portion of the developing roller when the seal member is elastically deformed, wherein the casing includes: an outer projection that is provided along a moving direction of the developing roller to abut on an outer end portion of the seal member, the outer projection protruding in a position which is inside the roller supporting unit; and an inner projection provided along the outer projection so as to abut on an inner end portion of the seal member, the inner projection protruding in a position which is outside the opening.

21 Claims, 5 Drawing Sheets

CASING PROJECTIONS OF AN IMAGE FORMING APPARATUS CONFIGURED TO SUPPORT A SEAL OF A DEVELOPING DEVICE

CROSS REFERENCE TO RELATED APPLICATION

The present application claims priority from Japanese Patent Application No. 2010-093602, which was filed on Apr. 15, 2010, the disclosure of which is herein incorporated by reference in its entirety.

TECHNICAL FIELD

Apparatuses and devices consistent with the present invention relate to a non-magnetic monocomponent developing device and an image forming apparatus including the developing device.

BACKGROUND

As this type of device, a device (so-called developing cartridge) disclosed in JP-2009-63635-A is known. This device is adapted so as to be detachably mounted on a body portion in an image forming apparatus, such as a laser printer. This device is adapted so as to supply a charged non-magnetic monocomponent developer to the surface of a photosensitive body provided within the image forming apparatus, and thereby develop an electrostatic latent image formed on the surface.

This device has therein a box-shaped casing which accommodates a non-magnetic monocomponent developer, and a developing roller which is rotatably supported by this casing. An opening is formed toward the developing roller in the casing. The developing roller includes a columnar roller body portion, and a non-magnetic monocomponent developer is carried on a columnar surface-like outer peripheral surface of the roller body portion.

Additionally, seal members (side seals) for suppressing (preventing) that a non-magnetic monocomponent developer leaks out to the outside on both ends of the roller body portion in the developing roller are fixed to the casing at positions facing the both ends. Here, in the non-magnetic monocomponent developing device, the above-described leak of a non-magnetic monocomponent developer to be used cannot be suppressed in non-contact with the developing roller by a magnetic means, such as a magnet. Thus, in the non-magnetic monocomponent developing device, the above-described seal member is provided so as to rub against both ends of the roller body portion while being elastically brought into contact therewith.

RELATED ART DOCUMENT

Patent Document

[Patent Document 1] JP-2009-63635-A

SUMMARY

In this type of device, even if so-called "seal collapse" which greatly deforms such that the seal member collapses along the direction of the central axis of the developing roller has occurred in any direction along the direction of the central axis, the sealing performance by the seal member deteriorates. The invention has been made in order to cope with the above problems. That is, the object of the invention is to provide a non-magnetic monocomponent developing device which can suppress more effectively that a non-magnetic monocomponent developer leaks out at both ends of a roller body portion in a developing roller.

The non-magnetic monocomponent developing device of the invention (hereinafter simply referred as "developing device") includes a developing roller, a casing, seal members. The developing roller includes a roller body portion. The roller body portion is adapted so as to be able to carry a non-magnetic monocomponent developer on a columnar surface-like outer peripheral surface.

The casing includes a developer storage unit and roller supporting units. The developer storage unit is formed in the shape of a box so as to store the developer therein. The roller supporting units are plate-shaped members, and are provided so as to protrude in a direction orthogonal to the direction (a direction parallel to the central axis (the rotational central axis) of the developing roller (hereinafter simply referred as "the direction of the central axis") of a central axis of the developing roller from the developer storage unit and thereby rotatably support the developing roller at both ends outside the roller body portion in the direction of the central axis. The casing is formed with an opening having a longitudinal direction along the central axis of the developing roller so as to make the developer storage unit and the roller supporting unit to communicate with each other.

The seal members are mounted on the casing outside the opening in the direction of the central axis so as to face the ends of the outer peripheral surface of the roller body portion in the direction of the central axis. The seal members are formed so as to rub against the ends of the outer peripheral surface in the direction of the central axis while being elastically deformed by being pressed in the radial direction of the roller body portion by the roller body portion.

The developing device typically includes a supply roller and a layer thickness regulating member. The supply roller is provided adjacent to the developing roller so as to rub against the outer peripheral surface in the developing roller, thereby making the developer carried on (supplied to) the outer peripheral surface. The layer thickness regulating member is provided so as to rub against the outer peripheral surface of the developing roller on which the developer is carried by the friction with the supply roller, and thereby regulate the carrying amount (thickness) of the developer on the outer peripheral surface. The layer thickness regulating member is typically a plate-shaped member having a longitudinal direction along the direction of the central axis, and is provided so as to rub against the outer peripheral surface of the developing roller at a tip portion which is one end in a direction orthogonal to the longitudinal direction and thickness direction.

The feature of the invention is that an outer projection and an inner projection are provided on the casing on both sides of the seal member in the direction of the central axis, and the seal member is supported between the outer projection and the inner projection while abutting on the outer projection and the inner projection. That is, the outer projection is provided along a direction (hereinafter simply referred to as a "movement direction") of movement of the outer peripheral surface facing the seal member by the rotation of the developing roller so as to abut on an outer edge of the seal member in the direction of the central axis. The outer projection is protrudingly provided inside the roller supporting unit in the direction of the central axis. In other words, the outer projection is provided at a position spaced apart from the roller supporting unit in the direction of the central axis. The inner projection is provided along the outer projection so as to abut on an inner edge of the seal member in the direction of the central axis. The inner projection is protrudingly provided outside (toward the outer peripheral surface) the opening in the direction of the central axis. In addition, the protruding height of the inner projection may be set to be equal to or less than the protruding height of the outer projection.

A protruding portion which protrudes along the movement direction may be provided at a downstream end of the seal member in the movement direction on the side of the outer projection. In this case, the inner projection includes a protruding-side abutting portion, an inner abutting portion, and a terminating abutting portion. The protruding-side abutting portion is provided so as to abut on an inner edge of the protruding portion in the direction of the central axis. The inner abutting portion is provided inside the protruding-side abutting portion in the direction of the central axis on the upstream side in the movement direction. The terminating abutting portion is provided along the direction of the central axis so as to connect the protruding-side abutting portion and the inner abutting portion together. The terminating abutting portion is adapted so as to abut a downstream edge, in the movement direction, of the portion of the seal member in which the protruding portion is not provided.

A leak developer storage unit, which is a space in which the protruding portion is not received, is formed on the downstream side of the protruding portion in the movement direction between the outer projection and the protruding-side abutting portion in the inner projection.

The casing may further include an upstream end abutting projection. The upstream end abutting projection is protrudingly provided so as to abut on an upstream edge of the seal member in the movement direction.

The inner projection may be provided so as to correspond to the outer projection along the movement direction. That is, the outer projection and the inner projection may be provided so as to face each other along the direction of the central axis, and may be formed such that the lengths thereof in the movement direction become almost equal to each other.

The length of the seal member in the direction of the central axis may be made greater than the width of a space between the inner projection and the outer projection in the direction of the central axis.

The seal member may be locked by the outer projection and the inner projection within the space therebetween.

In the developing device of the invention having such a configuration, the outer projection abuts on the outer edge of the seal member in the direction of the central axis. Additionally, the inner projection abuts on the inner edge of the seal member in the direction of the central axis. Thereby, the seal member is supported between the outer projection and the inner projection which are provided on both sides of the seal member in the direction of the central axis. Accordingly, occurrence of "seal collapse" along the direction of the central axis can be effectively suppressed on both inner and outer sides in the direction of the central axis. Additionally, by inserting the seal member to between the outer projection and the inner projection, mounting of the seal member to the casing of the seal member can be easily and favorably performed.

Particularly, the outer projection and the inner projection are provided so as to face each other along the direction of the central axis, and are formed such that the lengths thereof in the movement direction become almost equal to each other. Thereby, occurrence of "seal collapse" along the direction of the central axis can be more effectively suppressed on both inner and outer sides in the direction of the central axis.

Additionally, the seal member is provided with the protruding portion, and the protruding-side abutting portion, the inner abutting portion, and the terminating abutting portion are provided on the inner projection in correspondence with the protruding portion. Thereby, the edge of the inner projection which abuts on the seal member is formed in the shape of a crank. This can effectively suppress that the developer leaks out to the outside through a slight gap formed along the abutting portion between the seal member and the inner projection. Particularly, as the leak developer storage unit is formed, the leak of the developer as described above can be more effectively suppressed.

Additionally, mounting of the seal member to the casing can be easily and favorably performed by making the upstream edge of the seal member in the movement direction abut on the upstream abutting projection when the seal member is mounted to the casing.

Additionally, in a case where the protruding height of the inner projection is made lower than the protruding height of the outer projection, a force which pushes the seal member against the inner projection can be generated while favorably suppressing occurrence "seal collapse" along the direction of the central axis. Thereby, the seal member adheres to the inner projection well. Hence, the sealing performance of the developer by the seal member improves further.

Additionally, in a case where the length of the seal member in the direction of the central axis is made greater than the width of the space between the inner projection and the outer projection in the direction of the central axis, when the seal member is inserted to between the outer projection and the inner projection, the seal member is pinched between the outer projection and the inner projection. Thereby, the seal member adheres to the outer projection and the inner projection well. Hence, the sealing performance of the developer by the seal member improves further. Moreover, even if double-sided tape, it is possible lock the seal member reliably between the outer projection and the inner projection.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Hereinafter, embodiments of the invention will be described with reference to the accompanying drawings.

<Overall Configuration of Laser Printer>

Figure 1:
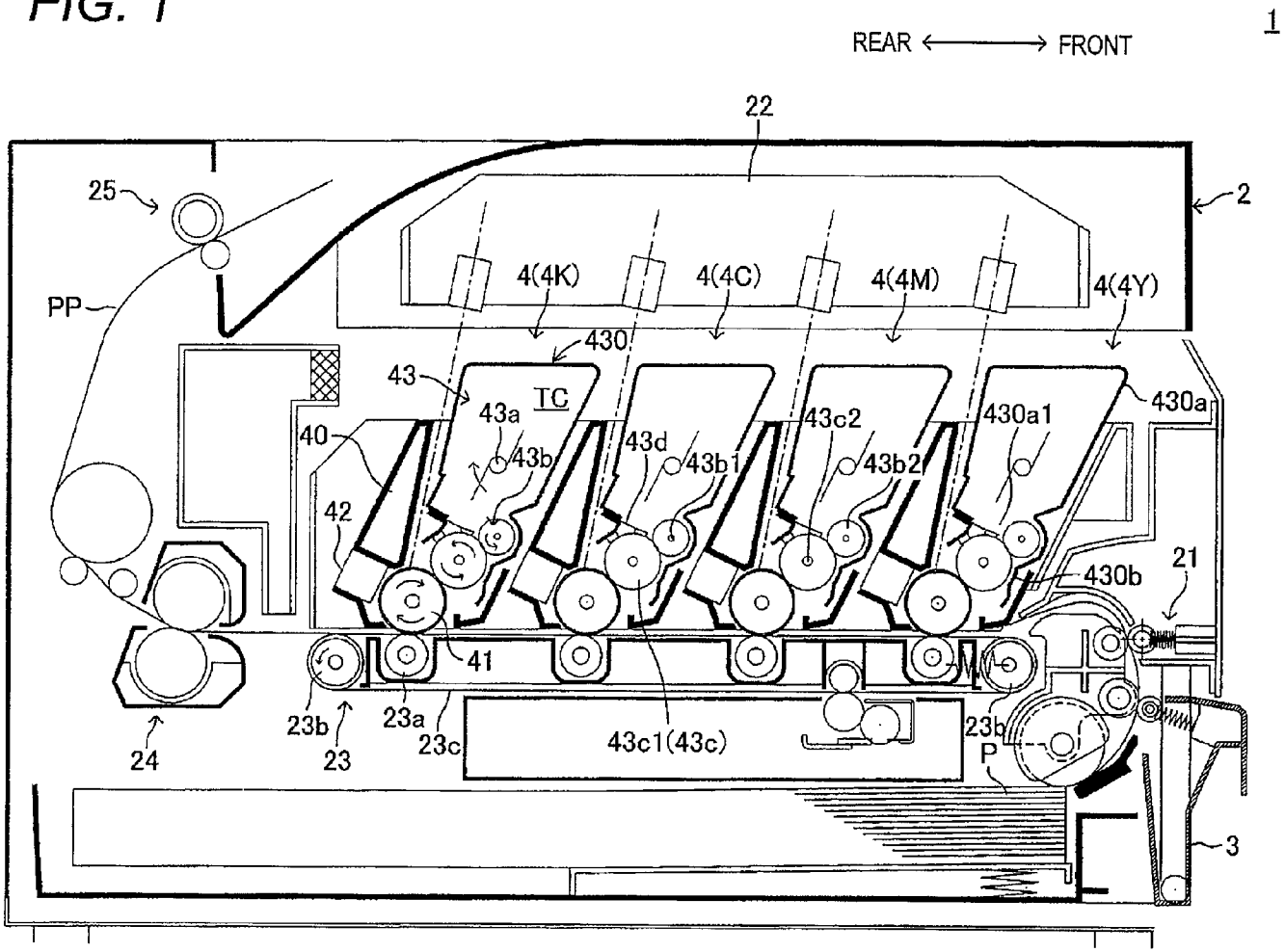
FIG. 1 is a side sectional view showing the overall configuration of a laser printer which is an example of an image forming apparatus to which one embodiment of the invention is applied.

FIG. 1 is a side sectional view showing the overall configuration of a laser printer 1 which is an example of an image forming apparatus to which one embodiment of the invention is applied. The laser printer 1 is adapted so as to form an image (hereinafter referred to as a toner image) by a non-magnetic monocomponent toner serving as a fine powdery dry developer on a paper P which is a sheet-like recording medium while transporting the paper P along a paper transport path PP (paper path) inside the printer.

In addition, in the following description, a direction (i.e., a tangential direction at an arbitrary position of the paper transport path PP) in which the paper P is transported along the paper transport path PP in FIG. 1 is referred to as "a paper transport direction". Additionally, the right side in the drawing is referred to as the "front side", and the left side in the drawing is referred to as the "rear side". Hence, the right-and-left direction in FIG. 1 becomes a front-and-rear direction of the laser printer 1. Moreover, the width direction of the laser printer 1 which is a direction (a direction perpendicular to the above-described front-and-rear direction and height direction of the laser printer 1) perpendicular to the right-and-left direction and the up-and-down direction in FIG. 1 is referred to as "paper width direction". This paper width direction is a direction perpendicular to the paper transport direction and the thickness direction of the paper P. Additionally, this paper width direction is also referred to as a "main scanning direction".

The laser printer 1 includes a body portion 2, a paper cassette 3, and a process cartridge 4. Inside the body portion 2, there are various kinds of mechanisms (details thereof will be described below) for performing image formation using a toner on the paper P while transporting the paper P along the paper transport path PP. The paper cassette 3 is provided below the body portion 2. The paper cassette 3 is made to slide in the front-and-rear direction, and is thereby detachably mounted on the body portion 2. A number of sheets of sheet-like paper P are received in a stacked state within the paper cassette 3.

The process cartridge 4 is detachably (replaceably) stored within the body portion 2. The toner is stored within the process cartridge 4. Here, the laser printer 1 in the present embodiment is adapted so as to be able to form a multicolor (so-called full-color) image, using four color toners of yellow, magenta, cyan, and black. Specifically, a plurality of process cartridges 4 (4Y, 4M, 4C, and 4K) is arrayed in this order in the paper transport direction along a spot where the paper transport path PP is formed almost straight in the front-and-rear direction in side sectional view inside the body portion 2. Yellow, magenta, cyan, and black toners are stored in the process cartridges 4Y, 4M, 4C, and 4K, respectively.

[Internal Configuration of Body Portion]

Hereinafter, details of the internal configuration of the body portion 2 will be described with reference to FIG. 1.

A paper feed unit 21 is adapted so as to a to pick up a top sheet of paper among a number of sheets of paper P stacked on the paper cassette 3 and transport the picked-up paper P toward the process cartridge 4Y, which is located on the most upstream side in the paper transport direction, among the plurality of process cartridges 4. An exposure unit 22 is adapted so as to generate a predetermined wavelength of laser light which is modulated (ON/OFF is controlled) in correspondence with image information, and supply the laser light to each process cartridge 4.

A transfer unit 23 is provided so as to face each of the plurality of process cartridges 4 (4Y, 4M, 4C, and 4K) which is arrayed inside the body portion 2 as described above. The transfer unit 23 is adapted so as to transfer a toner image to the paper P from each process cartridge 4 while transporting the paper P along the spot of the paper transport path PP which is formed almost straight in the front-and-rear direction in side sectional view as described above. Specifically, the transfer unit 23 includes a transfer roller 23*a*, a belt driving roller 23*b*, and a pair of paper transport belts 23*c*.

The transfer roller 23*a* is arranged parallel to the paper width direction, and is adapted to be rotatable about an axis parallel to the paper width direction. The transfer roller 23*a* is connected to a predetermined power source (not shown) such that a predetermined bias voltage for electrostatically attracting a toner toward the paper P is applied. The transfer roller 23*a* is provided so as to face the process cartridge 4. That is, in the present embodiment, a plurality of transfer rollers 23*a* of the same number as the number of the process cartridge 4 is arrayed along the spot of the paper transport path PP formed in the front-and-rear direction almost straight in side sectional view as described above.

One of the pair of belt driving rollers 23*b* is arranged further upstream in the sheet transport direction than the transfer roller 23*a* which face the process cartridge 4Y located on the most upstream side. The other of the pair of belt driving rollers 23*b* is arranged further downstream in the sheet transport direction than the transfer roller 23*a* which face the process cartridge 4K located on the most downstream side. The pair of belt driving rollers 23*b* is arranged parallel to the paper width direction, respectively, and is adapted to be rotatable about the axis parallel to the paper width direction. Also, one or the other in the pair of belt driving rollers 23*b* is rotationally driven by a driving source, such as motor (not shown).

The paper transport belt 23*c* is stretched over the pair of belt driving rollers 23*b* such that the inner surface thereof comes into contact with the peripheral surface of the transfer roller 23*a*. The outer surface of the portion of the paper transport belt 23*c*, which is arranged along the plurality of transfer rollers 23*a* between the pair of belt driving rollers 23*b*, is provided so as to face the process cartridges 4Y, 4M, 4C, and 4K. Such a portion is formed substantially in the shape of a plane so as to constitute the spot of the paper transport path PP which is formed almost straight in the front-and-rear direction in side sectional view as described above. Also, the paper transport belt 23*c* is adapted such that the outer surface thereof moves on an oblong orbit in side sectional view by the rotational driving of the pair of belt driving rollers 23*b*.

A fixing unit 24 is provided further downstream in the paper transport direction than the transfer unit 23. The fixing unit 24 is adapted so as to pressurize and heat the paper P, to which a toner has been transferred by the transfer unit 23, thereby fixing the toner on the paper P. A paper ejection unit 25 is provided further downstream in the sheet transport direction than the fixing unit 24. The paper ejection unit 25 is adapted such that the paper P, on which a toner has been fixed through the fixing unit 24, is ejected to the outside of the body portion 2.

<Process Cartridge>

A process frame 40 which forms a casing of the process cartridge 4 is mounted so as to be attachable to and detachable (replaceable) from the body portion 2. The process frame 40 is mounted with a photosensitive drum 41 and a charger 42. The photosensitive drum 41 is a cylindrical portion which has a photosensitive layer formed at an outer peripheral portion thereof, and is rotatably supported by the process frame 40. That is, the photosensitive drum 41 is rotationally driven about the axis parallel to the paper width direction, and thereby, an electrostatic latent image carrying surface which is the peripheral surface of the drum moves in a direction orthogonal to the paper width direction. The charger 42 is provided so as to face the electrostatic latent image carrying surface in order to charge the electrostatic latent image carrying surface uniformly.

The process frame 40 is detachably (replaceably) mounted on the developing cartridge 43. The developing cartridge 43 serving as the developing device of the invention is adapted such that a charged toner is supplied to the electrostatic latent image carrying surface on which an electrostatic latent image has been formed as laser light is irradiated thereto by the exposure unit 22 after being uniformly charged by the charger 42, thereby developing an electrostatic latent image with a toner.

The developing cartridge 43 includes an agitator 43*a*, a supply roller 43*b*, a developing roller 43*c* (including a developing roller body portion 43*c*1 and a developing roller shaft 43*c*2), and a layer thickness regulating blade 43*d*. The developing cartridge 43 is adapted so as to store a toner within a toner storage chamber TC which is the internal space thereof, and make a non-magnetic monocomponent toner carried on the developing roller 43*c* with a predetermined amount (thickness) while making the non-magnetic monocomponent toner charged by the friction between the supply roller 43*b* and the developing roller body portion 43*c*1 and by the friction between the developing roller body portion 43*c*1 and the layer thickness regulating blade 43*d*.

The agitator 43*a* is stored within the toner storage chamber TC. The agitator 43*a* is rotationally driven about the axis parallel to the paper width direction, and thereby, agitate the toner reserved within the toner storage chamber TC.

The supply roller 43*b* is constituted by a supply roller shaft 43*b*1 which is a metallic circular rod-shaped member parallel to the paper width direction, and a supply roller body portion 43*b*2 which is a sponge layer formed around the supply roller shaft. The supply roller 43*b* is provided adjacent to the developing roller 43*c* so as to make a toner carried on the outer peripheral surface thereof, as a columnar surface-shaped outer peripheral surface of the developing roller body portion 43*c*1 and the above-described supply roller body portion 43*b*2 rub against each other by the rotational driving about the above-described supply roller shaft 43*b*1.

The developing roller 43*c* is constituted by a columnar developing roller body portion 43*c*1, and a developing roller shaft 43*c*2 which is a metallic circular rod-shaped member parallel to the paper width direction. The developing roller 43*c* is provided parallel to the supply roller 43*b*. The developing roller 43*c* is rotationally driven in the same direction as the supply roller 43*b*, and thereby, rubs against the supply roller 43*b* at a nip portion (pressure contact portion) formed in cooperation with the supply roller while the columnar surface-like outer peripheral surface of the developing roller body portion 43*c*1 moves in the direction reverse to the supply roller body portion 43*b*2 in the above-described supply roller 43*b*.

The layer thickness regulating blade 43*d* is provided so as to protrude toward the above-described nip portion between the supply roller 43*b* and the developing roller 43*c*. The layer thickness regulating blade 43*d* is adapted so as to regulate the amount (thickness) of the toner carried on the outer peripheral surface as the tip portion of the blade in the above-described protruding direction abuts and rubs against the columnar surface-like outer peripheral surface of the developing roller body portion 43*c*1. Specifically, the layer thickness regulating blade 43*d* is constituted by a blade body made of a metal plate which has the longitudinal direction along the paper width direction, and a rubber tip provided at the above-described tip portion. In the present embodiment, the layer thickness regulating blade 43*d* is provided so as to perform so-called "counter abutting" on the columnar surface-like outer peripheral surface of the developing roller body portion 43*c*1 which is moved by the rotation of the developing roller 43*c*.

<Details of Configuration of Developing Casing>

Figure 2:
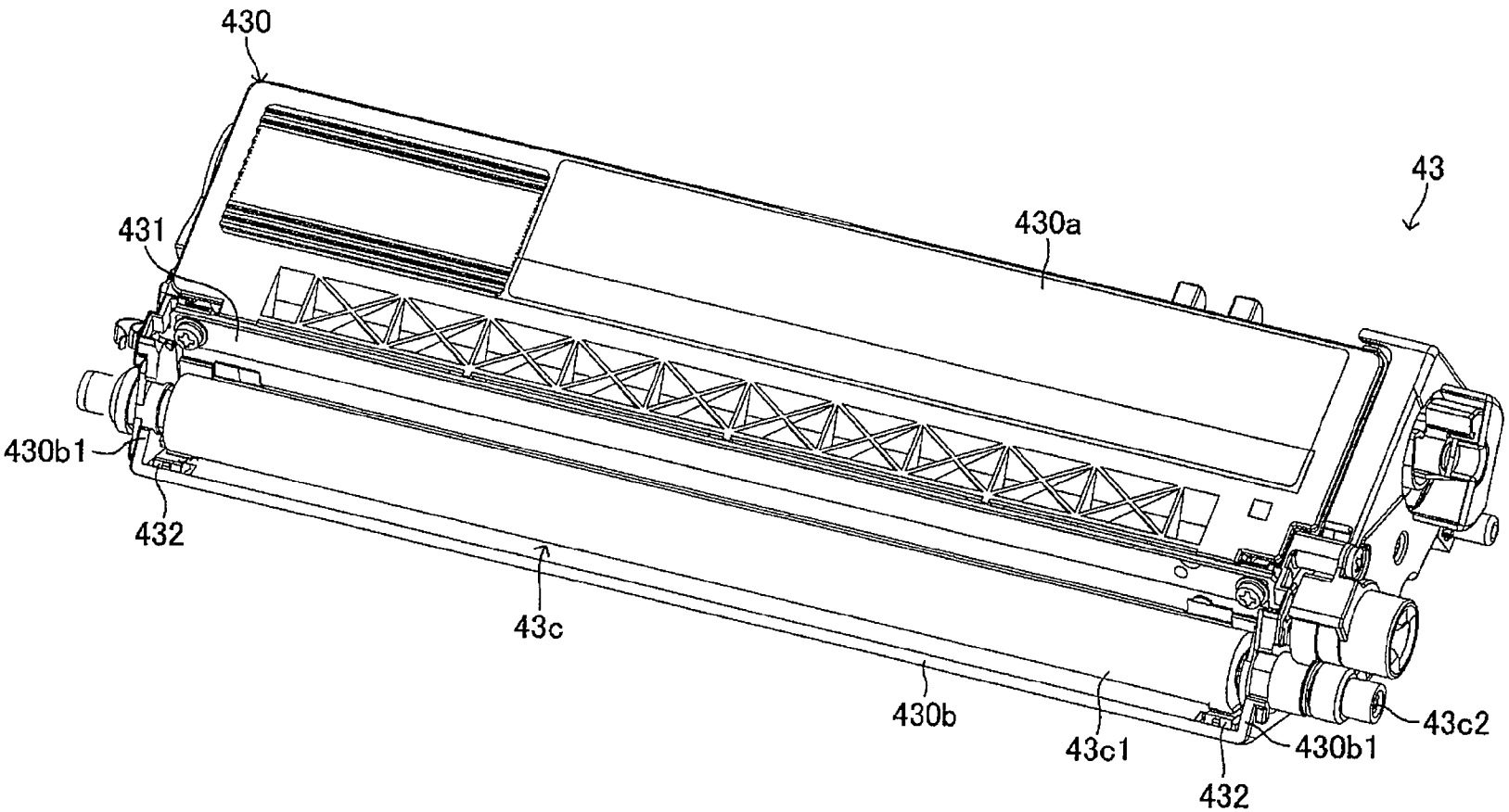
FIG. 2 is a perspective view when a developing cartridge shown in FIG. 1, which is one embodiment of a developing device of the invention, is seen from the developing roller side.
Figure 3:
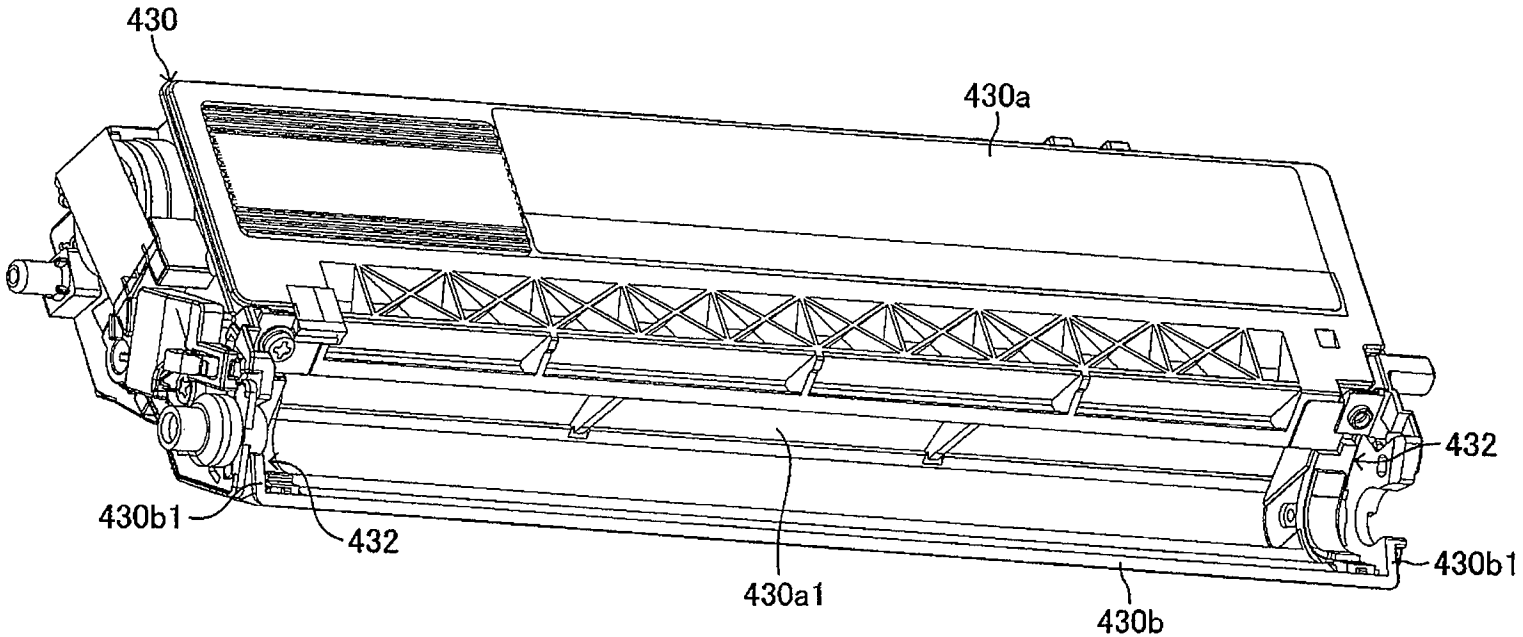
FIG. 3 is a perspective view showing a state where a developing roller and a layer thickness regulating blade are removed from the developing cartridge shown in FIG. 2.

A developing casing 430 equivalent to the casing of the invention which forms the casing of the developing cartridge 43 is adapted so as to store a toner and rotatably support the agitator 43*a*, the supply roller 43, and the developing roller 43*c*. FIG. 2 is a perspective view when the developing cartridge 43 shown in FIG. 1 is seen from the developing roller 43*c* side. FIG. 3 is a perspective view showing a state where the developing roller 43*e* and the layer thickness regulating blade 43*d* are removed from the developing cartridge 43 shown in FIG. 2. Hereinafter, the configuration of the developing casing 430 will be described in detail referring to other drawings FIGS. 1 to 3 if required.

The toner storage portion 430*a* which forms a body portion of the developing casing 430 is a box-shaped member which is formed such that a toner does not leak out to the outside from a spot other than an opening 430*a*1 provided at a position which faces the developing roller 43*c* while storing the toner in the internal toner storage chamber TC. The opening 430*a*1 is a through hole which is provided so as to make the toner storage portion 430*a* and the developing roller housing portion 430*b* communicate with each other in order to supply the toner stored within the toner storage chamber TC to the developing roller 43*c* via the supply roller 43*b*, and is formed in a substantially rectangular shape having a longitudinal direction along a central axis of the developing roller 43*c*.

The developing roller housing portion 430*b* is provided so as to protrude in the direction of the central axis of the developing roller 43*c* so as to open toward the outside of the developing casing 430 from the portion of the toner storage portion 430*a* in which the opening 430*a*1 is provided. That is, the developing roller housing portion 430*b* is provided such that the peripheral surface of the developing roller body portion 43*c*1 in which a toner is brought into a thin-layered carrying state by the friction with the layer thickness regulating blade 43*d* is exposed toward the photosensitive drum 41 outside the developing casing 430 at a position opposite to the nip portion formed in cooperation with the supply roller 43*b*.

The agitator 43*a* is rotatably supported at the position (position between the opening 430*a*1 and the wall surface most spaced apart from the opening 430*a*1) of the toner storage portion 430*a* deeper than the opening 430*a*1. The supply roller 43*b* is rotatably supported in the vicinity of the opening 430*a*1 in the toner storage portion 430*a*. The developing roller 43*c* is rotatably supported on a developing roller supporting units 430*b*1 (which will be described below) which are both ends, in the paper width direction, of the developing roller housing portion 430*b* outside the toner storage portion 430*a*.

As shown in FIGS. 2 and 3, the developing roller housing portion 430*b* includes a pair of developing roller supporting units 430*b*1. The developing roller supporting units 430*b*1 serving as the roller supporting units of the invention are plate-shaped members which form side plates of the developing roller housing portion 430*b*, and are formed so as to rotatably support the ends (portions exposed further outside in the direction of the central axis than the developing roller body portion 43*c*1) of the developing roller shaft 43*c*2 via bearings.

A blade supporting plate 431 (refer to FIG. 2), which is a metallic plate-shaped member for supporting a proximal end (an end opposite to the tip portion in the above-described protruding direction) of the layer thickness regulating blade 43*d*, is fixed to an upper end in the portion of the toner storage portion 430*a* where the opening 430*a*1 is provided. That is, the layer thickness regulating blade 43*d* is adapted such that the proximal end thereof is fixed to a top end (portion which faces the bottom face of the developing roller housing portion 430*b* with an opening 430*a*1 therebetween) in the portion of the toner storage portion 430*a* in which the opening 430*a*1 is provided via the blade supporting plate 431, and thereby, the above-described tip portion abuts (rubs) on the columnar surface-like outer peripheral surface of the developing roller body portion 43*c*1. Additionally, the blade supporting plate 431 is adapted so as to substantially block the opening 430*a*1 in a direction (the movement direction of the outer peripheral surface of the developing roller body portion 43*c*1 by the rotation of the developing roller 43*c*) perpendicular to the paper width direction, in cooperation with the developing roller body portion 43*c*1 and the layer thickness regulating blade 43*d*.

<Configuration of Portions Around Side Seal>

Referring to FIG. 3, a pair of side seals 432 serving as the seal members of the invention is mounted at positions which face the ends of the developing roller body portion 43*c*1 in the paper width direction outside the developing casing 430 in the paper width direction in the vicinity of the opening 430*a*1. That is, the side seals 432 are provided along a movement direction (refer to an arrow MD indicated by a two-dotted chain line in the drawing; hereinafter simply referred to as the "movement direction MD") of the outer peripheral surface of the above-described developing roller body portion 43*c*1, to outer ends of the bottom face of the developing roller housing portion 430*b* in the paper width direction from the face of the portion of the toner storage portion 430*a* in which the opening 430*a*1 is provided and which faces the developing roller 43*c* further outside in the paper width direction than the opening 430*a*1. The side seals 432 are adapted so as to rub against the outer peripheral surface at the ends while being elastically deformed by being pressed in the radial direction of the developing roller body portion 43*c*1 by the ends of the developing roller body portion 43*c*1 in the paper width direction.

Figure 4:
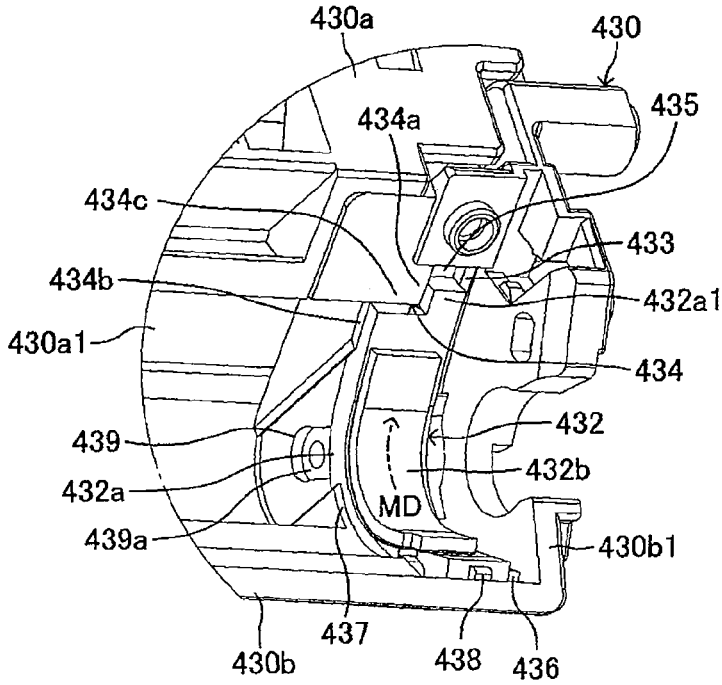
FIG. 4 is an enlarged perspective view showing the periphery of side seals shown in FIG. 3, serving as seal members of the invention.
Figure 5:
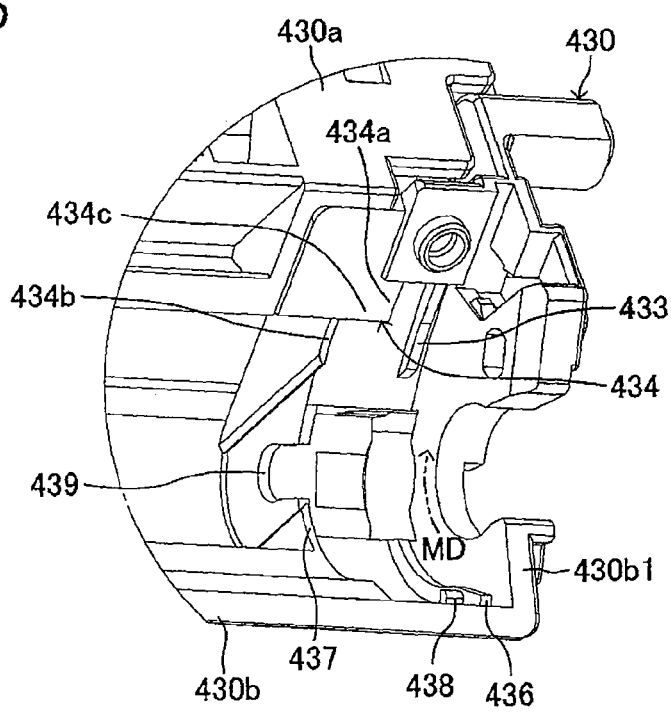
FIG. 5 is a perspective view showing a state where the side seals shown in FIG. 4 are removed.

FIG. 4 is an enlarged perspective view showing the periphery of side seals shown in FIG. 3, serving as the seal members of the invention. FIG. 5 is a perspective view showing a state where the side seals shown in FIG. 4 are removed. FIG. 6 is an enlarged sectional view showing the periphery of a side seal shown in FIG. 4.

As shown in FIG. 4, each side seal 432 includes a seal body 432*a* which is a plate-shaped elastic body made of foaming sponge. A protruding portion 432*a*1 is provided at a downstream end of the seal body 432*a* in the movement direction MD so as to protrude along the movement direction MD. In the present embodiment, the protruding portion 432*a*1 is provided at the position of the seal body 432*a* which is biased to the outside in the paper width direction. That is, a cutout portion is formed on the inner side in the paper width direction at a downstream end of the seal body 432*a* in the movement direction MD. Additionally, a sheeted sliding pile 432*b* is stuck on the face of the seal body 432*a* which faces the developing roller body portion 43*c*1.

A downstream portion (upper portion in FIG. 4) of the seal body 432*a* in the movement direction MD is locked between an outer rib 433 and an inner projection 434. The outer rib 433 and the inner projection 434 are provided so as to protrude toward the developing roller body portion 43*c*1 from the outside of the toner storage portion 430*a* in the paper width direction in the vicinity of the opening 430*a*1. The outer rib 433 and inner projection 434 are arranged so as to face each other along the paper width direction. In the present embodiment, the outer rib 433 and the inner projection 434 are formed such that the lengths thereof in the movement direction MD become almost the same.

The outer rib 433 serving as the outer projection of the invention is a ribbed projection having a longitudinal direction along the movement direction MD, and is provided so as to abut on the outer edge of the seal body 432*a* in the paper width direction. The outer rib 433 is arranged so as to be spaced apart from the inner wall surface of the developing roller supporting unit 430*b*1 inside the developing roller supporting unit 430*b*1 in the paper width direction.

The inner projection 434 is provided along the movement direction MD so as to abut on the inner edge of the seal body 432*a* in the paper width direction. The inner projection 434 in the present embodiment includes a protruding-side abutting portion 434*a*, an inner abutting portion 434*b*, and a terminating abutting portion 434*c*.

The protruding-side abutting portion 434*a* is arranged on the downstream side of the inner abutting portion 434*b* in the movement direction MD and outside the inner abutting portion in the paper width direction. The protruding-side abutting portion 434*a* is provided so as to abut on the inner edge of protruding portion 432*a*1 in the paper width direction. The inner abutting portion 434*b* is provided so as to abut on the inner edge of the seal body 432*a* in the paper width direction on the upstream side of the protruding portion 432*a* in the movement direction MD. The terminating abutting portion 434*c* is formed so as to connect the protruding abutting portion 434*a* and the inner abutting portion 434*b* together along the paper width direction. The terminating abutting portion 434*c* is provided so as to abut on a downstream edge, in the movement direction MD, of the portion (the portion inside the protruding portion 432*a*1 in the paper width direction) of the seal body 432*a* in which the protruding portion 432*a*1 is not provided. That is, the edge of the inner projection 434, which abuts on the downstream end of the seal body 432*a* in the movement direction MD, is formed in the shape of a crank.

The protruding-side abutting portion 434*a* is formed such that the length thereof in the movement direction MD is greater than the protruding portion 432*a*1. That is, a leak toner storage portion 435, which is a space (cavity) in which the protruding portion 432*a*1 is not received, is formed on the downstream side of the protruding portion 432*a*1 in the movement direction MD between the outer rib 433 and the protruding-side abutting portion 434*a*. The leak toner storage portion 435 is adapted so as to store the toner (the toner is an extremely small amount of toner if any) which is going to leak to the outside through a slight gap formed along an abutting portion between a downstream end, in the movement direction MD, of the portion of the seal body 432*a* in which the protruding portion 432*a*1 is not provided, and the inner projection 434 (inner abutting portion 434*b* and terminating abutting portion 434*c*), and thereby suppress leak of the toner.

An upstream portion (lower portion in FIG. 4) of the seal body in the movement direction MD 432*a* is locked between the outer rib 436 and the inner rib 437. The outer rib 436 and the inner rib 437 are provided so as to protrude toward the developing roller body portion 43*c*1 at the outer ends of the bottom faces, in the paper width direction, of the toner storage portion 430*a* and the developing roller housing portion 430*b*. The outer rib 436 and the inner rib 437 are arranged so as to face each other in the paper width direction. In the present embodiment, the outer rib 436 and the inner rib 437 are formed such that the lengths thereof in the movement direction MD become almost the same.

The outer rib 436 serving as the outer projection of the invention is a ribbed projection having a longitudinal direction along the movement direction MD, and is provided so as to abut on the outer edge of the seal body 432*a* in the paper width direction. The outer rib 436 is arranged so as to be spaced apart from the inner wall surface of the developing roller supporting unit 430*b*1 inside the developing roller supporting unit 430*b*1 in the paper width direction. The inner rib 437 serving as the outer projection of the invention is a ribbed projection having a longitudinal direction along the movement direction MD, and is provided parallel to the outer rib 436 so as to abut on the inner edge of the seal body 432*a* in the paper width direction.

Figure 6A:
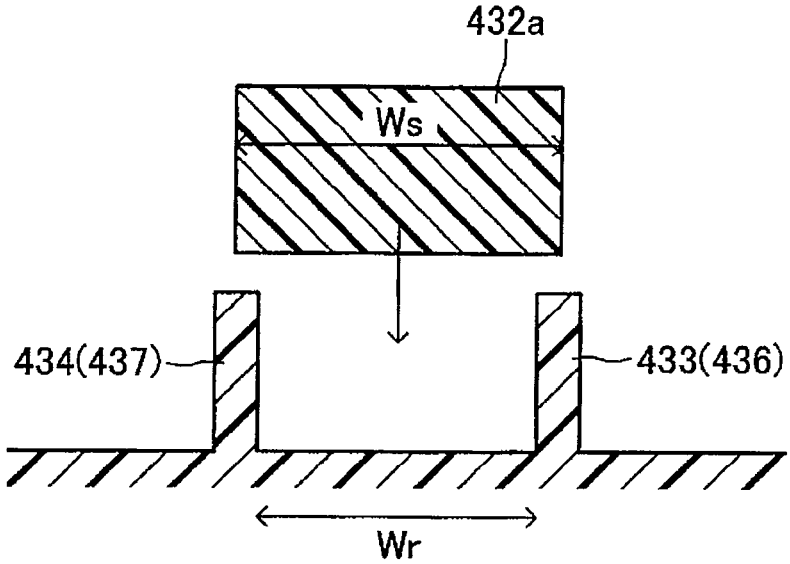
FIG. 6A and FIG. 6B are enlarged sectional views showing the periphery of the side seal shown in FIG. 4.
Figure 6B:
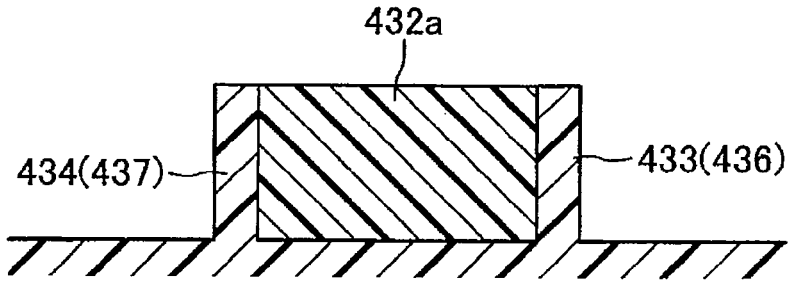

As shown in FIG. 6A, in the present embodiment, the seal body 432*a* is formed such that the free length Ws thereof in the paper width direction (right-and-left direction in the drawing) becomes greater than the width Wr of the space between the outer rib 433 and the inner projection 434 (between the outer rib 436 and the inner rib 437). That is, as shown in FIG. 6B, the seal body 432*a* is inserted into between the outer rib 433 and the inner projection 434 (between the outer rib 436 and the inner rib 437), and is thereby locked (fitted without using double-sided tape) while being compressed along the paper width direction.

Additionally, in the present embodiment, the inner projection 434 is formed such that the protruding height thereof becomes the same as that of the outer rib 433. Similarly, the inner rib 437 is formed such that the protruding height thereof becomes the same as that of the outer rib 436. Specifically, in the present embodiment, the outer rib 433, the inner projection 434, the outer rib 436, and the inner rib 437 are formed such that the protruding heights thereof become the same as each other.

An upstream end abutting rib 438 is provided at a position which faces (abuts on) an upstream edge (lower and near edge in FIG. 4) of the seal body 432*a* in the movement direction MD. The upstream end abutting rib 438 is formed so as to protrude toward the developing roller body portion 43*c*1 from the bottom face of the developing roller supporting unit 430*b*1.

Supply roller shaft insertion portions 439 which are cutout portions are formed at side walls (partition walls) provided at both ends, in the paper width direction, of the portion of the toner storage portion 430*a* in which the supply roller body portion 43*b*2 (refer to FIG. 1) is received. A supply roller shaft seal 439*a* is provided at a position corresponding to each supply roller shaft insertion portion 439 so as to be adjacent to (adhere to) the outside of the above-described side wall in the paper width direction. The supply roller shaft seal 439*a* is composed of sponge which is an elastic body, and is provided so as to suppress leak of a toner to the outside from the supply roller shaft insertion portion 439 (a gap between the supply roller shaft insertion portion 439 and the supply roller shaft 43*b*1) as the supply roller shaft 43*b*1 (refer to FIG. 1) exposed from the supply roller body portion 43*b*2 at both ends of the supply roller 43*b* is inserted.

In the present embodiment, the supply roller shaft seal 439*a* is provided so as to elastically adhere to the face of the seal body 432*a* opposite to the face thereof on which the sliding pile 432*b* is stuck. That is, the supply roller shaft seal 439*a*, and the seal body 432*a* are adapted so as to adhere to each other by their own elasticity.

<Working and Effects According to Embodiment>

In the present embodiment, the outer rib 433 and the inner projection 434 (the outer rib 436 and the inner rib 437) are provided with almost the same length in the movement direction MD on both sides of each side seal 432 (seal body 432*a*). Thereby, both edges of the side seal 432 (seal body 432*a*) in the paper width direction are supported well by the outer rib 433 and the inner projection 434. Hence, occurrence of "seal collapse" in the side seal 432 is favorably suppressed on both inner and outer sides in the paper width direction.

That is, a cutout portion is formed on the inner side in the paper width direction at a downstream end of the side seal 432 (seal body 432*a*) in the movement direction MD. Also, the edge of the inner projection 434, which abuts on the downstream end of the side seal (seal body 432*a*) in the movement direction MD in correspondence with such cutout portion, is formed in the shape of a crank. Moreover, the leak toner storage portion 435 is formed on the downstream side of the protruding portion 432*a*1 in the movement direction MD between the outer rib 433 and the protruding-side abutting portion 434*a* in the inner projection 434.

Accordingly, according to the configuration of the present embodiment, leak of a toner from the side seal 432 to the outside in the paper width direction is effectively suppressed. That is, according to this configuration, leak of the non-magnetic monocomponent developer at both ends of the developing roller body portion 43*c*1 is more effectively suppressed.

Additionally, according to the configuration of the present embodiment, mounting of the side seal 438 is simply and favorably performed by making the upstream end of the side seal 432 in the movement direction MD abut on the upper end abutting rib 438. Moreover, the side seal 432 can be reliably locked between the outer rib 433 and the inner projection 434 (between the outer rib 436 and the inner rib 437) without using double-sided tape. In this case, since the supply roller shaft seal 439*a* and the seal body 432*a* come into contact with each other elastically at an abutting (adhering) portion therebetween, even if both the supply roller shaft seal and the seal body are not secured to each other with double-sided tape, leak of a toner through between both can be favorably suppressed.

<Illustration of Modification>

In addition, the above-described embodiment is merely illustrative of a representative embodiment of the invention that the present applicant dares to regard as being best at filing of the present application. Hence, the invention is not limited to the above-described at all from the first. Accordingly, it is apparent that various modifications can be performed on the above-described embodiment without changing a substantial part of the invention. In the following, several representative modifications are illustrated. However, it is needless to say that invention is not limited to the modifications illustrated below. Additionally, all or some of the embodiment and the modifications can be appropriately and can be applied mutually complexly within a technically consistent range. The invention (particularly, those expressed in terms of actions or functions in individual constituent elements which constitute means for solving the problems of the invention) is not limitedly interpreted on the basis of the above-described embodiment and the following modifications. This limited interpretation is not allowed because it deprives of applicant's profits unfairly, whereas it benefits an imitator unfairly.

The application target of the invention is not applied to a laser printer capable of forming a multi-color image. For example, the invention can be appropriately applied to so-called electro-photographic image forming apparatuses, such as a monochromatic laser printer and a monochromatic and color copying machine. For example, the invention can also be appropriately applied to a developer supply device in an image forming apparatus of a type (a multi-stylus electrode type, an ion flow type, a toner jet type, or the like) which does not use a photosensitive body.

Instead of the paper transport belt 23*c* in the above-described embodiment, an intermediate transfer belt or photosensitive belt on the surface of which a toner image can be carried may be used. In this case, the configuration of the process cartridge 4 or the paper feed unit 21, the arrangement of the fixing unit 24 or the paper ejection unit 25, and the aspect of the transport path PP based on these are appropriately changed from the configurations in the above-described embodiment.

The invention is not limited at all to the specific configuration of the process cartridge 4 like the above-described embodiment. That is, for example, the process frame 40 may be fixed to the body portion 2. Otherwise, the process frame 40 and the developing casing 430 may be integrally (undetachably) configured. Otherwise, in a case where a photosensitive belt is used instead of the paper transport belt 23*c* as described above, the process frame 40 is omitted, and the plurality of developing cartridges 43 is arrayed along the spot of the paper transport path PP which is formed almost straight in the front-and-rear direction in side sectional view as described above.

The free length Ws of the main body of the seal may be the same as the width Wr. Additionally, the sliding pile 432*b* can be omitted.

Figure 7:
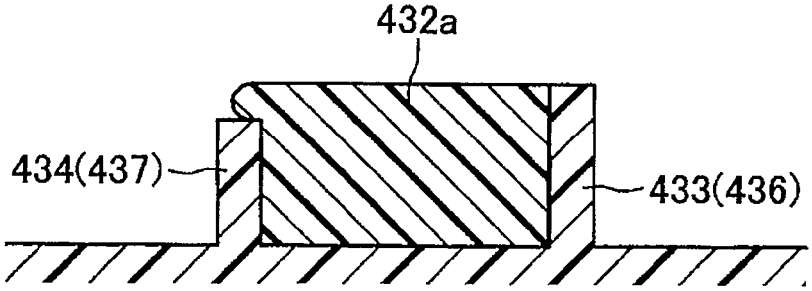
FIG. 7 is a sectional view showing the configuration of a modification of an outer rib and an inner projection (an outer rib and an inner rib) shown in FIG. 6.

FIG. 7 is a sectional view showing the configuration of a modified example of the outer rib 433 and the inner projection 434 (the outer rib 436 and the inner rib 437) shown in FIG. 6. As shown in FIG. 7, in the present modification, the inner projection 434 is formed such that the protruding height thereof becomes lower than that of the outer rib 433. Similarly, the inner rib 437 is formed such that the protruding height thereof becomes lower than that of the outer rib 436.

In this configuration, the inner portion of the seal body 432*a* in the paper transport direction which is an upper end of the seal body protrudes from the inner projection 434 and the inner rib 437, and thereby a force which pushes the seal body 432*a* against the inner projection 434 and inner rib 437 is generated. Thereby, the seal body 432*a* adheres to the inner projection 434 and the inner rib 437 well while holding a state where the "seal collapse" in the paper width direction is suppressed. Accordingly, the sealing performance by the side seal 432 improves further.

In addition, only either the protruding height of the inner projection 434 is lower than the outer rib 433 or the protruding height of the inner rib 437 is lower than the outer rib 436 may be realized.

The protruding height of the outer rib 433 and the outer rib 436 may be appropriately set according to the shape of the side seal 432. That is, the protruding height of the outer rib 433 and the protruding height of the outer rib 436 may be different from each other depending on the shape of the side seal 432.

The protruding-side abutting portion 434*a* and the terminating abutting portion 434*c* do not form a single projection portion unlike that shown in FIG. 4, and may be formed as separate ribbed projections.

In addition, it is apparent that the modifications which are not particularly mentioned are also included in the technical scope of the invention without departing from the changing the substantial part of the invention. Additionally, elements expressed in terms of actions or functions in individual elements which constitute means for solving the problems of the invention also include any structures capable of realizable the above actions and functions, other than the specific structure disclosed in the above-described embodiment and the following modifications. Moreover, the contents (including the specification and the drawings) of other applications or publications cited in the preset specification constitute a portion of the present specification, and can be incorporated by reference within a technically consistent range if required.

What is claimed is:

1. A developing device comprising:

a developing roller including a roller body portion configured to carry a non-magnetic monocomponent developer on an outer peripheral surface thereof;

a casing including:

a developer storage unit having a boxed shape and configured to store the developer therein;

a roller supporting unit which protrudes in a direction perpendicular to a central axis direction of the developing roller from the developer storage unit and rotatably supports both end portions of the developing roller outside the roller body portion in the central axis direction; and an opening which extends in a longitudinal direction along the central axis direction so as to provide communication between the developer storage unit and the roller supporting unit; and a seal member that is mounted on the casing outside the opening in the central axis direction and faces an end portion of the outer peripheral surface of the roller body portion in the central axis direction, the seal member configured to rub against the end portion of the outer peripheral surface in the central axis direction when the seal member is elastically deformed by being pressed in a radial direction of the roller body portion by the roller body portion, wherein the seal member includes a protruding portion that protrudes along a movement direction of the developing roller at a downstream end portion of the seal member in the movement direction, wherein the casing includes:

an outer projection that is provided along the moving direction of the developing roller so as to abut an outer end portion of the seal member in the central axis direction, the outer projection protruding in a position inside of the roller supporting unit in the central axis direction; and an inner projection that is provided along the outer projection so as to abut an inner end portion of the seal member in the central axis direction, the inner projection protruding in a position which is outside the opening in the central axis direction, wherein the protruding portion of the seal member is provided closer to the outer projection than the inner projection, and wherein the inner projection includes:

a protruding-side abutting portion that abuts an inner end portion of the protruding portion in the central axis direction;

an inner abutting portion that is provided inside the protruding-side abutting portion in the central axis direction, the inner abutting portion provided on an upstream side in the movement direction than the protruding-side abutting portion; and a terminating abutting portion that is provided along the central axis direction so as to connect the protruding-side abutting portion and the inner abutting portion, the terminating abutting portion abutting a downstream end portion, in the movement direction, of a portion of the seal member in which the protruding portion is not provided.

2. The developing device according to claim 1, wherein a leak developer storage unit, which is a space in which the protruding portion is not received, is formed on the downstream side of the protruding portion in the movement direction between the outer projection and the protruding-side abutting portion of the inner projection.

3. The developing device according to claim 1, wherein the casing further includes an upstream end abutting projection that protrudes so as to abut an upstream end portion of the seal member in the movement direction.

4. The developing device according to claim 1, wherein the inner projection is provided so as to correspond to the outer projection along the movement direction.

5. The developing device according to claim 1, wherein a protruding height of the inner projection is equal to or less than a protruding height of the outer projection.

6. The developing device according to claim 1, wherein a length of the seal member in the central axis direction is greater than a width of a space between the inner projection and the outer projection in the central axis direction.

7. The developing device according to claim 1, wherein the seal member is locked by the outer projection and the inner projection within a space therebetween.

8. An image forming apparatus comprising:

a sheet accommodating unit that accommodate a sheet; and the developing device according to the claim 1.

9. A developing device comprising:

a developing roller including a roller body portion configured to carry a non-magnetic monocomponent developer on an outer peripheral surface thereof;

a casing including:

a developer storage unit having a boxed shape and configured to store the developer therein;

a roller supporting unit which protrudes in a direction perpendicular to a central axis direction of the developing roller from the developer storage unit and rotatably supports both end portions of the developing roller outside the roller body portion in the central axis direction; and an opening which extends in a longitudinal direction along the central axis direction so as to provide communication between the developer storage unit and the roller supporting unit; and a seal member that is mounted on the casing outside the opening in the central axis direction and faces an end portion of the outer peripheral surface of the roller body portion in the central axis direction, the seal member configured to rub against the end portion of the outer peripheral surface in the central axis direction when the seal member is elastically deformed by being pressed in a radial direction of the roller body portion by the roller body portion, wherein the casing includes:

an outer projection that is provided along a moving direction of the developing roller so as to abut an outer end portion of the seal member in the central axis direction, the outer projection protruding in a position inside of the roller supporting unit in the central axis direction;

an inner projection that is provided along the outer projection so as to abut an inner end portion of the seal member in the central axis direction, the inner projection protruding in a position which is outside the opening in the central axis direction; and an upstream end abutting projection that protrudes so as to abut an upstream end portion of the seal member in the movement direction.

10. The developing device according to claim 9, wherein the inner projection is provided so as to correspond to the outer projection along the movement direction.

11. The developing device according to claim 9, wherein a protruding height of the inner projection is equal to or less than a protruding height of the outer projection.

12. The developing device according to claim 9, wherein a length of the seal member in the central axis direction is greater than a width of a space between the inner projection and the outer projection in the central axis direction.

13. The developing device according to claim 9, wherein the seal member is locked by the outer projection and the inner projection within a space therebetween.

14. An image forming apparatus comprising:

a sheet accommodating unit that accommodate a sheet; and the developing device according to the claim 9.

15. A developing device comprising:

a developing roller including a roller body portion configured to carry developer on an outer peripheral surface thereof;

a casing including:

a developer storage unit having a boxed shape and configured to store the developer therein;

a roller supporting unit which protrudes in a direction perpendicular to a central axis direction of the developing roller from the developer storage unit and rotatably supports both end portions of the developing roller outside the roller body portion in the central axis direction; and an opening which extends in a longitudinal direction along the central axis direction so as to provide communication between the developer storage unit and the roller supporting unit; and a seal member that is mounted on the casing outside the opening in the central axis direction and faces an end portion of the outer peripheral surface of the roller body portion in the central axis direction, wherein the seal member comprises:

a first side surface, which is an outer surface in the central axis direction, provided along a moving direction of the developing roller; and a second side surface, which is an inner surface in the central axis direction, provided along the moving direction of the developing roller, and wherein the casing includes:

an outer projection that is provided along the moving direction of the developing roller so as to abut and contact the first side surface of the seal member in the central axis direction, the outer projection protruding in a position which is inside the roller supporting unit in the central axis direction; and an inner projection that is provided along the outer projection so as to abut and contact the second side surface of the seal member in the central axis direction, the inner projection protruding in a position which is outside the opening in the central axis direction.

16. The developing device according to claim 15, wherein the seal member includes a protruding portion that protrudes along the movement direction at a downstream end portion of the seal member in the movement direction, the protruding portion provided to be closer to the outer projection than the inner projection, and wherein the inner projection includes:

a protruding-side abutting portion that abuts an inner end portion of the protruding portion in the central axis direction;

an inner abutting portion that is provided inside the protruding-side abutting portion in the central axis direction, the inner abutting portion provided on an upstream side in the movement direction than the protruding-side abutting portion; and a terminating abutting portion that is provided along the central axis direction so as to connect the protruding-side abutting portion and the inner abutting portion, the terminating abutting portion abutting a downstream end portion, in the movement direction, of a portion of the seal member in which the protruding portion is not provided.

17. The developing device according to claim 16, wherein a leak developer storage unit, which is a space in which the protruding portion is not received, is formed on the downstream side of the protruding portion in the movement direction between the outer projection and the protruding-side abutting portion of the inner projection.

18. The developing device according to claim 15, wherein the casing further includes an upstream end abutting projection that protrudes so as to abut an upstream end portion of the seal member in the movement direction.

19. The developing device according to claim 15, wherein the inner projection is provided so as to correspond to the outer projection along the movement direction.

20. The developing device according to claim 15, wherein a protruding height of the inner projection is equal to or less than a protruding height of the outer projection.

21. The developing device according to claim 15, wherein a length of the seal member in the central axis direction is greater than a width of a space between the inner projection and the outer projection in the central axis direction.

* * * * *